US006220979B1

(12) United States Patent
Chan

(10) Patent No.: US 6,220,979 B1
(45) **Date of Patent: *Apr. 24, 2001**

(54) INFLATABLE STITCHED SPORTS BALL AND METHOD OF MAKING SAME

(76) Inventor: Chong Veng Chan, 5/F, Knutsford Commercial Bldg., 4 Knutsford Terrace, TsimShaTsui, Kowloon (HK)

( * ) Notice: Subject to any disclaimer, the term of this patent is extended or adjusted under 35 U.S.C. 154(b) by 0 days.

This patent is subject to a terminal disclaimer.

(21) Appl. No.: 09/489,055

(22) Filed: Jan. 21, 2000

Related U.S. Application Data

(62) Division of application No. 09/313,826, filed on May 18, 1999, which is a division of application No. 09/063,555, filed on Apr. 21, 1998, now Pat. No. 6,039,662.

(51) Int. Cl.[7] ..... A63B 41/08
(52) U.S. Cl. ..... 473/599; 473/604
(58) Field of Search ..... 473/598, 599, 473/604, 603, 605, 609; 156/169, 170, 171, 172; 273/DIG. 20

(56) References Cited

U.S. PATENT DOCUMENTS

| | | | |
|---|---|---|---|
| 3,506,265 | 4/1970 | Yugi | 473/604 |
| 4,660,831 | 4/1987 | Kralik | 473/603 |
| 4,856,781 | 8/1989 | Shishido et al. | 473/603 |
| 5,413,331 | 5/1995 | Stillinger | 473/599 |
| 5,759,123 | 6/1998 | Ou | 473/599 |
| 5,772,545 | 6/1998 | Ou | 473/605 |
| 6,039,662 * | 3/2000 | Chan | 473/604 |

* cited by examiner

*Primary Examiner*—Steven Wong
(74) *Attorney, Agent, or Firm*—Fish & Richardson P.C.

(57) ABSTRACT

An inflatable sports ball has a body with a multiplicity of discrete panels joined together at seams along respective adjacent edges by stitching, preferably machine stitching, to define a volume, and an inflatable bladder disposed within the volume, with a valve extending through an aperture defined in the body outer surface. Each ball panel is formed of a multi-layer laminate consisting of an outer layer of synthetic polymeric material, an intermediate layer of expanded synthetic polymeric material and a woven fabric, and an inner layer of woven fabric. A method for manufacturing an inflatable sports ball using a stitching machine to join pairs of panels at a seam along respective adjacent edges is also described.

7 Claims, 5 Drawing Sheets

INFLATABLE STITCHED SPORTS BALL AND METHOD OF MAKING SAME

This application is a divisional of U.S. application Ser. No. 09/313,826, filed May 18, 1999, which is a divisional of U.S. application Ser. No. 09/063,555, filed Apr. 21, 1998 now U.S. Pat. No. 6,039,662.

The invention relates to inflatable, multi-panel, stitched sports balls and methods for making same.

BACKGROUND OF THE INVENTION

Inflatable sports balls, such as soccer balls, volley balls, hand balls consist of an outer body in the form of a sphere and an inflatable bladder disposed therein. Sports balls of this type are often formed by joining discrete panels together, e.g. by stitching, along their respective adjacent edges. Shishido et al. U.S. Pat. No. 4,856,781 suggests use of a sewing or stitching machine to join the panels together.

To enhance durability, and to resist enlargement of the ball over time, e.g. due to action of the compressed air contained within the bladder, a sports ball may have a wound core, i.e., an inflatable bladder covered with windings of thread, e.g. nylon yarn.

SUMMARY OF THE INVENTION

According to one aspect of the invention, an inflatable sports ball having a body comprising a multiplicity of discrete panels joined together at seams along respective adjacent edges by stitching to define a volume, and an inflatable bladder disposed within the volume and having a valve extending through an aperture defined in the outer surface of the body. Each panel of the multiplicity of panels is formed of a multi-layer laminate comprising: an outer layer of synthetic polymeric material; an intermediate layer of expanded synthetic polymeric material with a woven or knitted fabric; and at least one inner layer of woven fabric.

Preferred embodiments of this aspect of the invention may include one or more of the following additional features. The stitching comprises machine stitching. The inner layer of woven fabric comprises two layers of woven fabric. The bladder is formed of resilient material. The bladder is joined to an inner surface of the body in a region about the valve stem. The sports ball is a soccer ball, a volley ball or a hand ball.

According to another aspect of the invention, a method for manufacture of an inflatable sports ball comprising a body formed of a multiplicity of discrete panels and containing an inflatable bladder comprises the steps of: forming a laminate comprising an outer layer of synthetic polymeric material, an intermediate layer of expanded synthetic polymeric material with a woven or knitted fabric, and at least one inner layer of woven fabric; cutting the laminate into a plurality of panels of appropriate shape and size, each panel having an inner surface and an outer surface; placing a pair of panels with respective outer surfaces in face to face engagement, and, using a stitching machine, joining the pair of panels at a seam along their respective adjacent edges; repeating the previous step with additional pairs of panels to form an assembly of panels having the shape of a sports ball body and defining a volume; reversing the assembly of panels through an opening in the assembly of panels to form a sports ball body defining a volume; inserting an inflatable bladder through the opening into the volume of the sports ball body; positioning a valve stem of the bladder through an aperture provided in the sports ball body; and securing the opening into the sports ball body.

Preferred embodiments of this aspect of the invention may include one or more of the following additional features. The method comprises the further step of joining together opposed surfaces of the bladder and sports ball body within the volume in a region about the valve stem. The method comprises the further step of trimming the exposed end of the valve stem to adjacent the outer surface of the sports ball body. The method comprises the further step of securing the opening in the sports ball body by hand stitching. The opening comprises an open seam in the sports ball body.

Other features and advantages of the invention may be seen from the following description of a presently preferred embodiment, and from the claims.

BRIEF DESCRIPTION OF THE DRAWINGS

In FIG. 6, two adjacent panels are oriented with outer surfaces in opposed relationship; in FIG. 7, the two panels are joined by machine stitching along respective adjacent edges to form a multi-panel assembly; and, in FIG. 8, the outer surface of the multi-panel assembly of FIG. 7 is shown.

In FIG. 9, the inflatable bladder is positioned for insertion through an open seam into the volume of the body of a multi-panel, machine stitched sports ball; in FIG. 10, the bladder is positioned within the sports ball body (shown partially in section), with the valve stem disposed to extend through an aperture in the ball body surface; in FIG. 11, the body and bladder (both shown partially in section) are secured together about the region of the valve stem; and, in FIG. 12, excess valve stem extending from the surface of the ball is trimmed.

DESCRIPTION OF THE PREFERRED EMBODIMENTS

Figure 1:
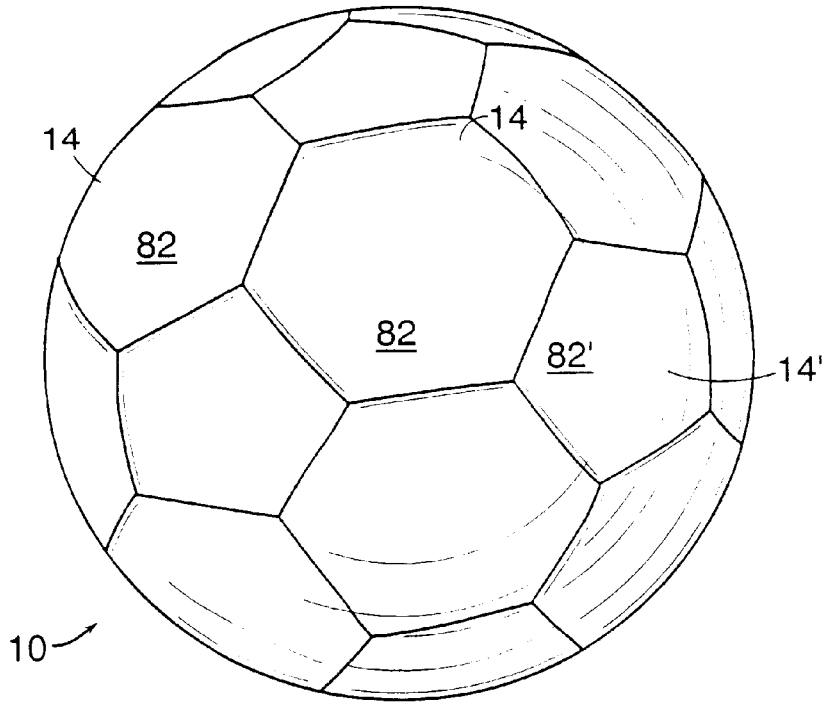
FIG. 1 is a perspective view of an inflatable, multi-panel, stitched sports ball, in this case, a soccer ball, of the invention.
Figure 2:
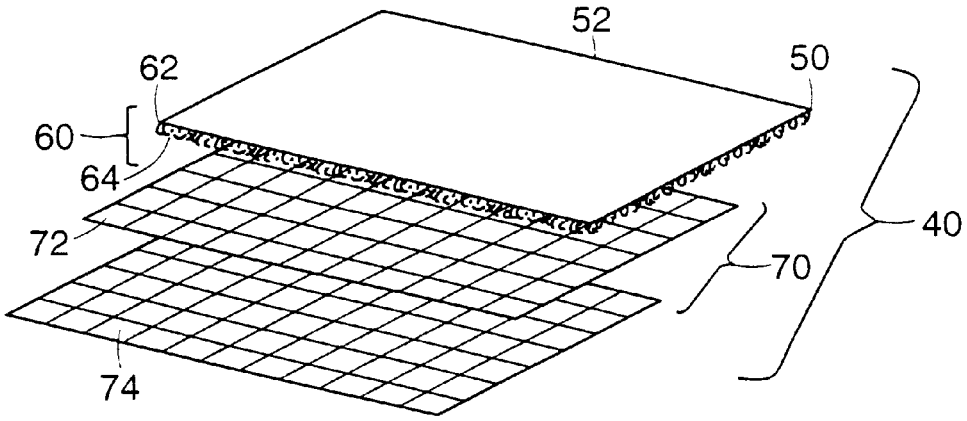
FIG. 2 is an exploded view of a laminate sheet for forming the inflatable, multi-panel, stitched sports ball of FIG. 1.
Figure 3:
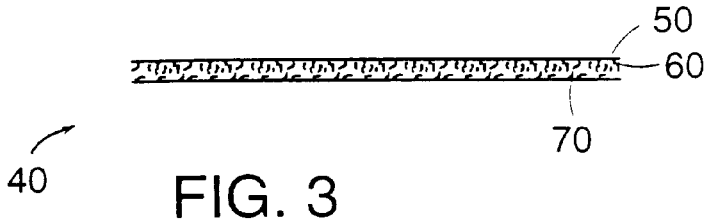
FIG. 3 is a side section view of the laminate sheet of FIG. 2.
Figure 4:
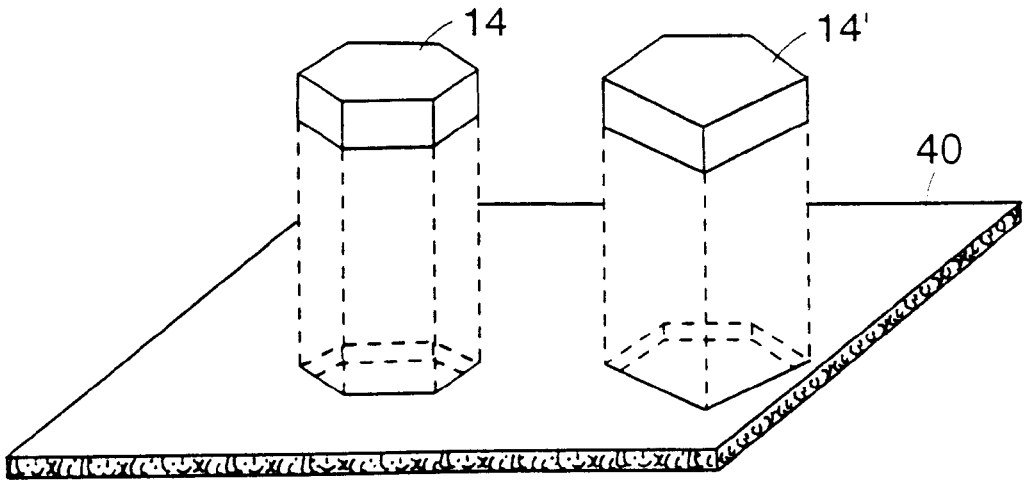
FIGS. 4 and 5 are somewhat diagrammatic views of panels cuts from the laminate sheet of FIGS. 2 and 3 for forming the inflatable, multi-panel, stitched sports ball of FIG. 1, e.g. a soccer ball and a volley ball, respectively, by the method of the invention.
Figure 5:
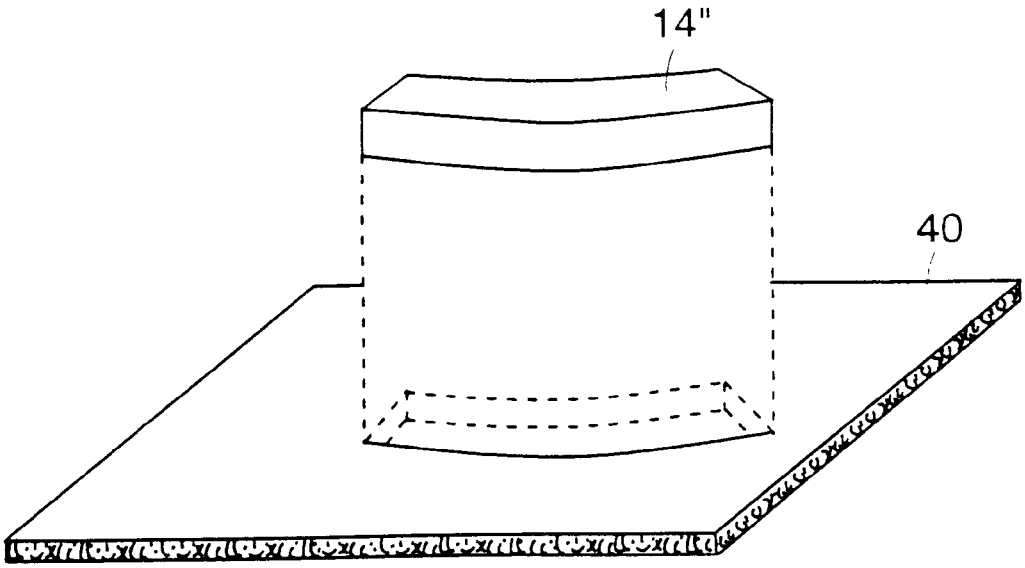

Referring to FIGS. 1 and 9–12, an inflatable sports ball 10 has a body 12 formed of a multiplicity of discrete panels 14, 14' defining a volume 16. The panels are joined together at a seam 18 along respective adjacent edges 20, 22 by machine stitching 24. An inflatable bladder 26 is disposed within the volume. The bladder has a valve stem 28 extending through an aperture 30 defined in the outer surface 34 of the ball body.

Each panel 14, 14', 14" is formed of a multi-layer laminate 40 consisting of an outer layer 50, e.g. of synthetic polymeric material 52, an intermediate layer 60, e.g. of expanded synthetic polymeric material 62 and a woven fabric 64, and at least one inner layer 70, e.g. preferably of two woven fabric layers 72, 74.

Referring now to FIGS. 2–12, a method for manufacture of the inflatable sports ball 10 discussed above will next be described.

Figure 6:
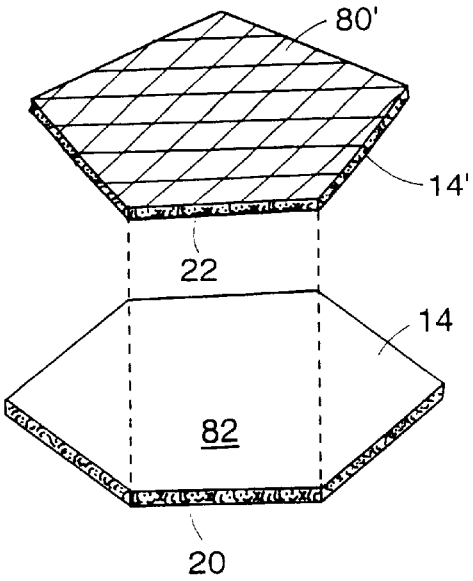
FIGS. 6, 7 and 8 are sequential, somewhat diagrammatic views of steps of the method of the invention for joining adjacent panels by machine stitching to form a multi-panel assembly during manufacture of the inflatable sports ball of FIG. 1.
Figure 7:
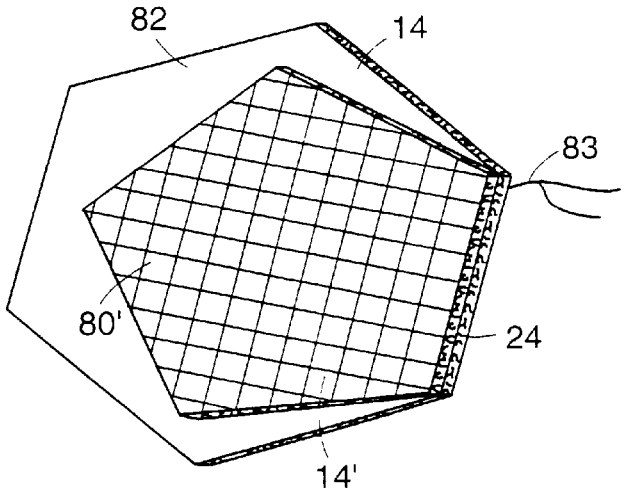
Figure 8:
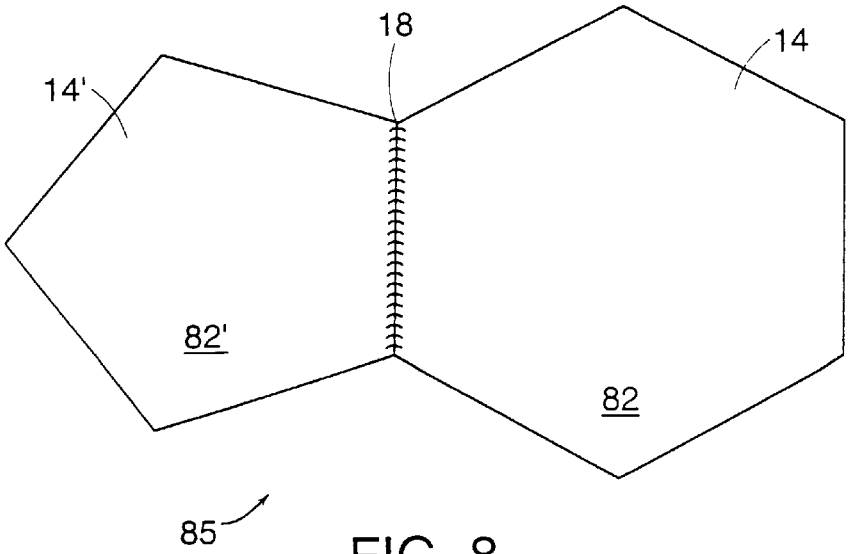

First, a laminate 40 (FIGS. 2 and 3) is formed by methods known to those skilled in the art. The laminate consists of an outer layer 50, e.g. of synthetic polymeric material, an intermediate layer 60, e.g. of expanded synthetic polymeric material and a woven fabric, and at least one inner layer 70, e.g. preferably of two layers of woven fabric. The laminate is cut into a plurality of panels 14, 14', 14" of appropriate shape and size (FIGS. 4 and 5), each panel having an inner surface 80 and an outer surface 82. A pair of panels 14, 14' are placed with their outer surfaces 82, 82', respectively, in face-to-face engagement (FIG. 6). Using a stitching machine 83, the pair of panels are joined at the seam 18 along their respective adjacent edges (FIG. 7) to form a multi-panel assembly 85 (FIG. 8). The step of joining pairs of panels at the seam along their adjacent edges is repeated for additional pairs of panels (including panels already joined in other pairs of panels) to form an assembly of panels having the shape of a sports ball body and defining a volume (the assembly at this stage having the panel outer surfaces facing into the volume to facilitate machine stitching of the seams). The assembly of panels thus formed are next reversed through an open seam 84 in the assembly of panels, e.g. typically through an opening between the adjacent edges of one pair of panels, to form a sports ball body defining a volume 86 (the assembly of panels by this operation now having the panel inner surfaces facing into the volume, the process of machine stitching having been essentially completed).

Figure 9:
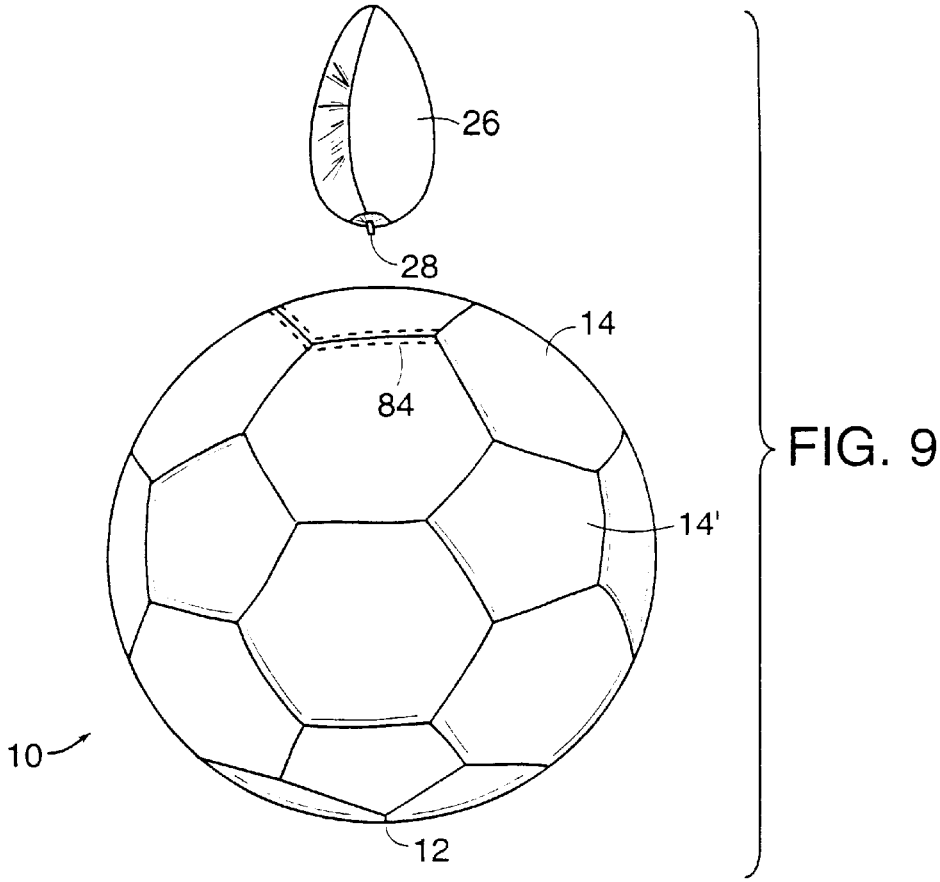
FIGS. 9, 10, 11 and 12 are sequential, somewhat diagrammatic views of method of the invention for assembling an inflatable sports ball of FIG. 1.
Figure 10:
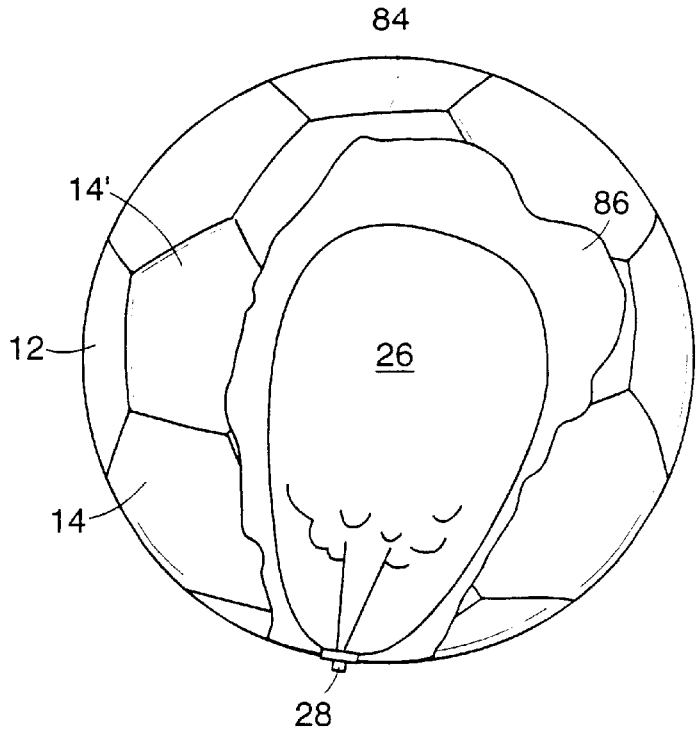
Figure 11:
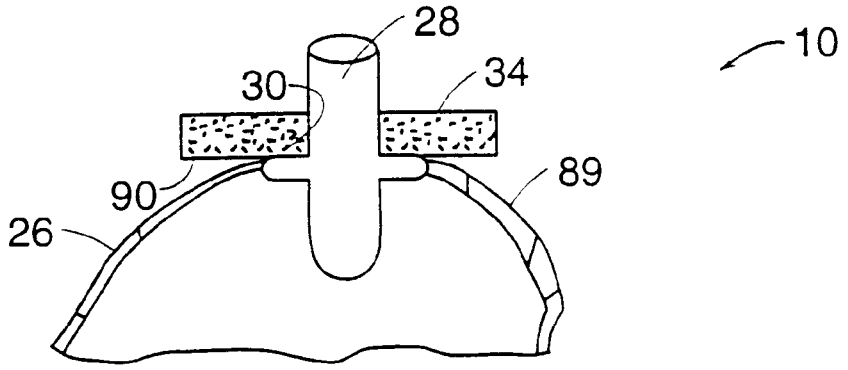
Figure 12:
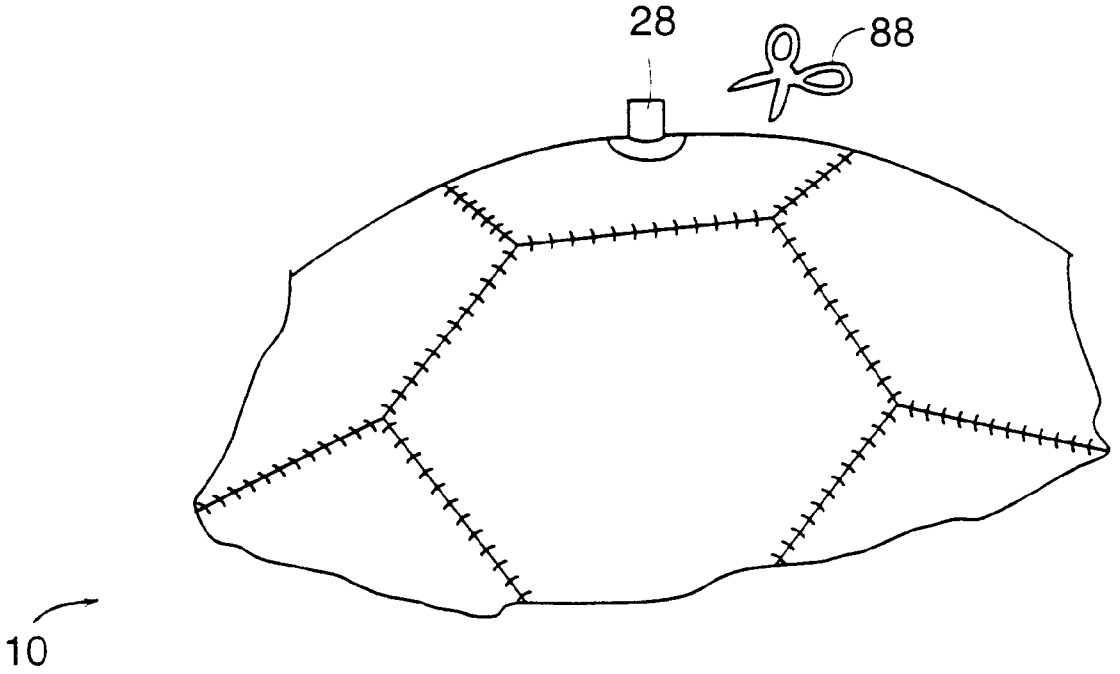

An inflatable bladder 26 is inserted through the open seam 84 into the volume 16 of the sports ball body 12 (FIGS. 9 and 10). The valve stem 28 of the bladder is positioned to extend through the aperture 30 provided in the outer surface of the sports ball body. Preferably, the opposed surfaces 89, 90 of the bladder and the inner surface of the sports ball body, respectively, are secured together, e.g. with adhesive, in the region about the valve stem, to secure the position of the bladder within the body (FIG. 11). The valve stem 28 extending beyond the surface of the ball is trimmed, e.g. with scissors 88.

The open seam 84 in the sports ball body 12 is then secured, e.g. by hand stitching.

In preferred embodiments, the synthetic material of the laminate 50 (FIG. 3) is high foamed PVC (poly vinyl chloride), has a thickness between about 1.6 to 2.5 mm, preferably about 2.2 mm for soccer balls, 1.8 mm for volley balls, and a weight of between about 900 to 1,600 gms, preferably about 1,600 gms for soccer balls 940 gms for volley balls, for a sheet 54 inches by 36 inches at 2.2 mm thickness. The softness depends on the density of the laminate material, i.e. the degree of porosity, which can be varied to accommodate the requirements of the purchaser. The fabric 62 (FIG. 3) of the preferred laminate is poly/viscose, having a yarn count of 13s/2 by 13s/2, a warp and weft of 29 by 29, and a weight of about 210 to 215 gms per square meter for soccer balls, 235 to 240 gms per square meter for volley balls. The outer laminate layer is between about 0.25 to 0.30 mm thick, preferably about 0.30 mm thick. The intermediate layer is formed with a foaming rate of between about 1:2 to 1:2.2, preferably about 1:2 for soccer balls, 1:2.2 for volley balls. The T/R woven or knitted fabric backing of the inner layer has a weight of about 10 pounds. The bladder is formed of 70 to 80% butyl rubber with 20 to 30% natural rubber. The preferred adhesive used in forming the laminate is not less than 60% purity of latex.

The result is an inflatable sports ball with a softer feeling and more comfort to a human body striking or struck by the ball, e.g. during play. This is compared to prior art inflatable sports balls with cores formed of windings of thread, e.g. nylon yarns, acting as a reinforcing layer to minimize circumferential enlargement of the ball, and to improve durability. Replacement of the windings in the inflatable sports ball of the invention also allows the ball to keep its proper roundness when deflated and the re-inflated. This is in contrast to prior art inflatable sports balls with cores of windings of thread in which, upon re-inflation, friction between winding threads and the cover can cause de-shaping of panels to make the ball out of roundness.

The method of the present invention also permits considerable reduction in production time and costs. For example, a typical skilled worker can hand-stitch, on average, four pieces per day. In contrast, a skilled worker using the method of the present invention employing stitching machines can produce hundreds of pieces in the same time period.

Incorporation of the fabric layers within the laminate of the body of the sports ball also results in considerable savings of production time and cost, e.g. as compared to prior art sports balls in which the inflatable bladder is formed of stitched fabric panels.

The inflatable sports ball of the invention is also durable, e.g. due to the layers of fabric incorporated into the laminate of the body of the ball, and due to the layer of expanded synthetic material, which serves to absorb impact upon the outer surface of the ball. The rebound is also more moderate when dropped as the FIFA specifications require.

Other embodiments are within the following claims. For example, the synthetic material of the laminate may be a combination of poly urethane and poly vinyl chloride. The fabric of the laminate may be a combination of poly ester and poly rayon, with a yarn count of 32s/2+2 by 32s/2+2, and a warp and weft of 25 by 25. The bladder may be formed of 100% latex.

What is claimed is:

1. An inflatable sports ball having a body comprising:

a multiplicity of discrete panels joined together at seams along respective adjacent edges by stitching to define a volume, wherein said seams are constructed so that said adjacent edges are disposed within said volume, and an inflatable bladder disposed within said volume and having a valve extending through an aperture defined in the outer surface of said body, each panel of said multiplicity of panels being formed of a multi-layer laminate comprising:

an outer layer of synthetic polymeric material;

an intermediate layer of expanded synthetic polymeric material and a woven fabric; and an inner layer of woven fabric.

2. The inflatable sports ball of claim 1, wherein said stitching comprises machine stitching.

3. The inflatable sports ball of claim 1, wherein said inner layer of woven fabric comprises two layers of woven fabric.

4. The inflatable sports ball of claim 1, wherein said bladder is formed of resilient material.

5. The inflatable sports ball of claim 1, wherein said bladder is joined to an inner surface of said body in a region about said valve stem.

6. The inflatable sports ball of claim 1, wherein said sports ball is a soccer ball.

7. The inflatable sports ball of claim 1, wherein said sports ball is a volley ball.

* * * * *